US006817384B2

(12) United States Patent
Chang

(10) Patent No.: US 6,817,384 B2
(45) Date of Patent: Nov. 16, 2004

(54) METHOD OF WEAVING STRAW DECORATIVE RIBBON BY PLASTIC TAPE

(76) Inventor: Ming-Che Chang, 1F, No. 17, Jui Yang Street, Chang Hua City (TW)

( * ) Notice: Subject to any disclaimer, the term of this patent is extended or adjusted under 35 U.S.C. 154(b) by 238 days.

(21) Appl. No.: 10/187,611

(22) Filed: Jul. 3, 2002

(65) Prior Publication Data

US 2004/0003858 A1 Jan. 8, 2004

(51) Int. Cl.[7] ..... D03D 15/02

(52) U.S. Cl. ..... 139/424; 139/385; 139/384 A; 139/383 B; 442/186

(58) Field of Search ..... 139/385, 387 A, 139/384 A, 424, 383 B; 442/186

(56) References Cited

U.S. PATENT DOCUMENTS 1,470,097 A * 10/1923 Neff ..... 112/409
2,135,413 A * 11/1938 Rosenstein ..... 139/384 R
3,653,230 A * 4/1972 Tosco ..... 66/85 R
4,510,975 A * 4/1985 Ojanpera ..... 139/384 R
4,957,784 A * 9/1990 Ripamonti ..... 428/5
5,389,421 A * 2/1995 Pearlman ..... 428/82
5,395,665 A * 3/1995 Planeta ..... 428/36.1
6,450,208 B1 * 9/2002 Khokar ..... 139/11
6,539,983 B2 * 4/2003 Khokar ..... 139/383 A

* cited by examiner

*Primary Examiner*—John J. Calvert
*Assistant Examiner*—Robert H. Muromoto, Jr.
(74) *Attorney, Agent, or Firm*—Troxell Law Office PLLC

(57) ABSTRACT

In an improved method of weaving straw decorative ribbons by plastic tapes, the plastic tape is used as the warp or weft, and a nylon string as the weft or warp to weave a piece of cloth by the square weaving method of a weaving machine, such that the plastic tape and nylon are weaved with each other in a predetermined distance apart, and the plastic tapes are weaved and leaned against each other like a piece of cloth, and the side proximate to the weaved position is cut such that each plastic weaved unit has a weaved section and a tassel section, and both sides of the weaved section are stitched to fix the plastic tape and to prevent the edge of the cloth from drawing out. The present invention accomplishes the fast manufacturing of decorative ribbons for all kinds of articles, simulates the man-made straw umbrella by using plant materials, and provides a way for mass production and effectively lowers the cost.

4 Claims, 6 Drawing Sheets

METHOD OF WEAVING STRAW DECORATIVE RIBBON BY PLASTIC TAPE

BACKGROUND OF THE INVENTION

1. Field of the Invention

The present invention relates to an improved method of manufacturing straw decorative ribbon by plastic tape, more particularly to a method of using plastic tapes of different colors and arranging the plastic tapes equidistant from each other as required for weaving a piece of cloth by the square weave method of a weaving machine; cutting the weaved section at an appropriate position such that each weaved ribbon has a weaved section and a tassel section; after sewing both sides of the weaved section, the ribbon is fixed by a plastic tape, and then each unit of the weaved tapes is stacked and leaned with each other, and directly sewing the weaved sections around the canopy of an umbrella to simulate a hand-made straw weaved umbrella. The present invention can also be used as a regular decorative ribbon to save cost and attain the economic effects for mass production.

2. Description of the Prior Art

In general, a conventional straw weaved umbrella makes use of local herbaceous plants as raw materials, and weaves the raw material on a bamboo stand by hands. However, the material of herbaceous plants, regardless of hay, coconut matting, or the like is very limited in quantity. The time and effort of weaving a straw canopy by hands are relatively large, and thus the cost is also high. Furthermore, the transportation of such canopy is very inconvenient, and very difficult to meet the requirement of mass production. The way of using such canopy is also very limited, which cannot be reused by others; this is one of the shortcomings of the conventional straw weaved umbrella.

Therefore, there is an improved manufacturing method as shown in FIG. 4. Such method also uses plastic tapes 1 as raw materials to attain the effects of a straw decorative ribbon. A stripe of cloth is used to fix the plastic tape 1, and the plastic tape 1 is folded into halves and then hung on the stripe of cloth 2. The plastic tape 1 is fixed to the stripe of cloth 2 by sewing stitches 21 to form a straw decorative ribbon. However, the coupling of the plastic tape 1 and the cloth stripe has to fold the plastic tape 1 by hands first, and then hang the cloth stripes 2 one by one. The hanging and fixing of the plastic tapes may not be able to give a neatly arranged tassel, and it is inevitable to have a disordered appearance, and the speed for the production is slow. Therefore, it takes more labor for the manufacture, and thus increases the cost.

In view of the shortcomings of the prior art as mentioned above, the inventor of the present invention based on years of experience accumulated from the engagement in the related industry conducted extensive research to resolve the foregoing shortcomings and invented the manufacturing method of the present invention to enhance the production capacity and reduce the cost.

SUMMARY OF THE INVENTION

The primary objective of the present invention is to provide an improved method of manufacturing straw umbrella or decorative ribbon by weaving plastic tapes, in which plastic tapes of different colors are used to weave a piece of cloth by the square weaving method of a weaving machine, and the distance between the weaved sections depends on the required length of the weave, and stitches are sewed along the side of the weaved section, and then the cloth is cut at the position proximate to the weaved section such that each unit of plastic weaved ribbons has a tassel in the weaved section, and the weaved section can be stacked or leaned with each other and be sewed around the canopy of the umbrella. Such arrangement forms a straw umbrella like structure for easy storage and transportation, and also provides a way for mass production and cost reduction.

The secondary objective of the present invention is to provide an improved method of manufacturing straw umbrella or decorative ribbon by weaving plastic tapes, of which the plastic weaved ribbon units can be used for all kinds of decorative ribbons.

To make it easier for our examiner to understand the objective of the invention, structure, innovative features, and performance, we use a preferred embodiment together with the attached drawings for the detailed description of the invention.

BRIEF DESCRIPTION OF THE DRAWINGS

Other objects, features, and advantages of the invention will become apparent from the following detailed description of the preferred but non-limiting embodiment. The description is made with reference to the accompanying drawings, in which.

DETAILED DESCRIPTION OF THE PREFERRED EMBODIMENT

Figure 1A:
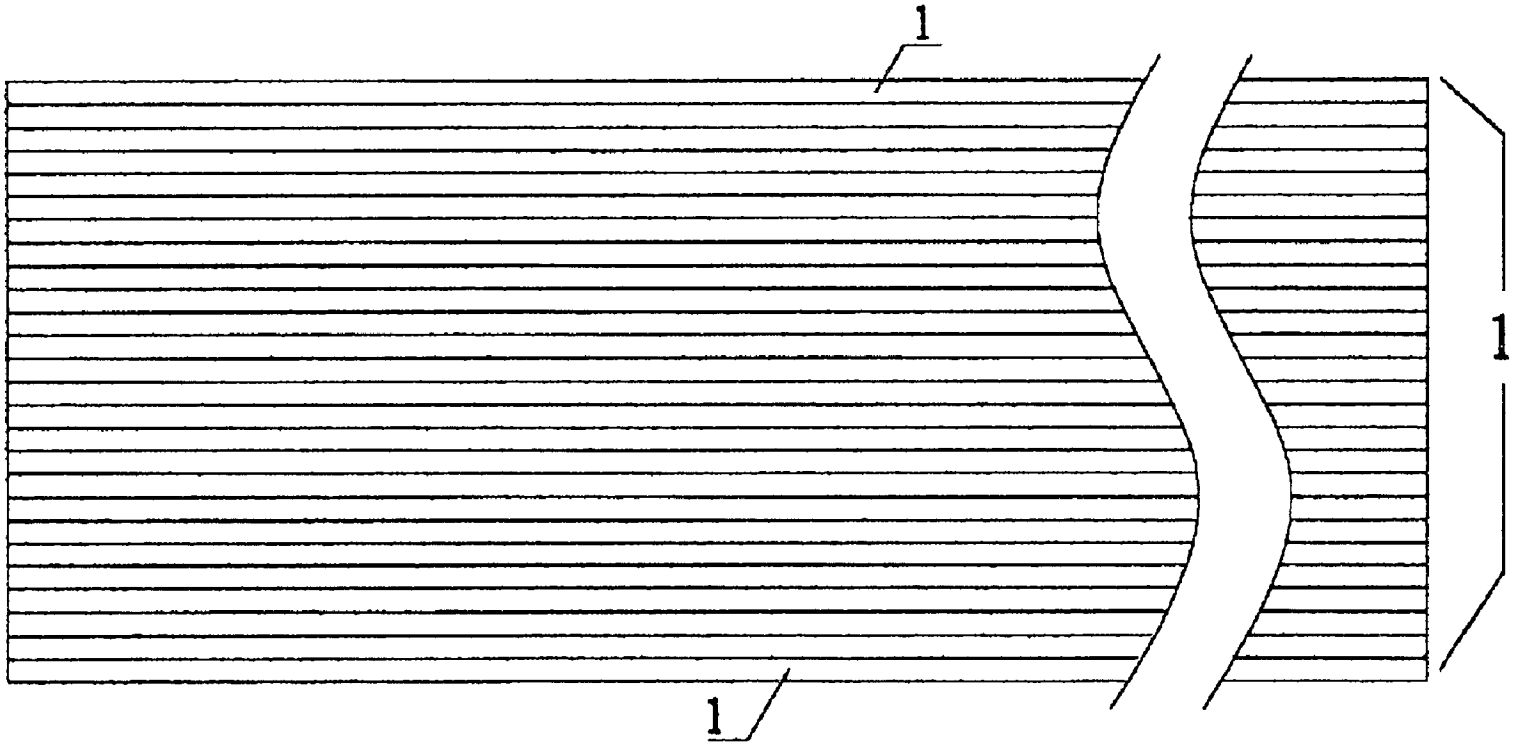
FIG. 1A is a schematic diagram of using plastic string as the warp and weft for a weaving machine.
Figure 1B:
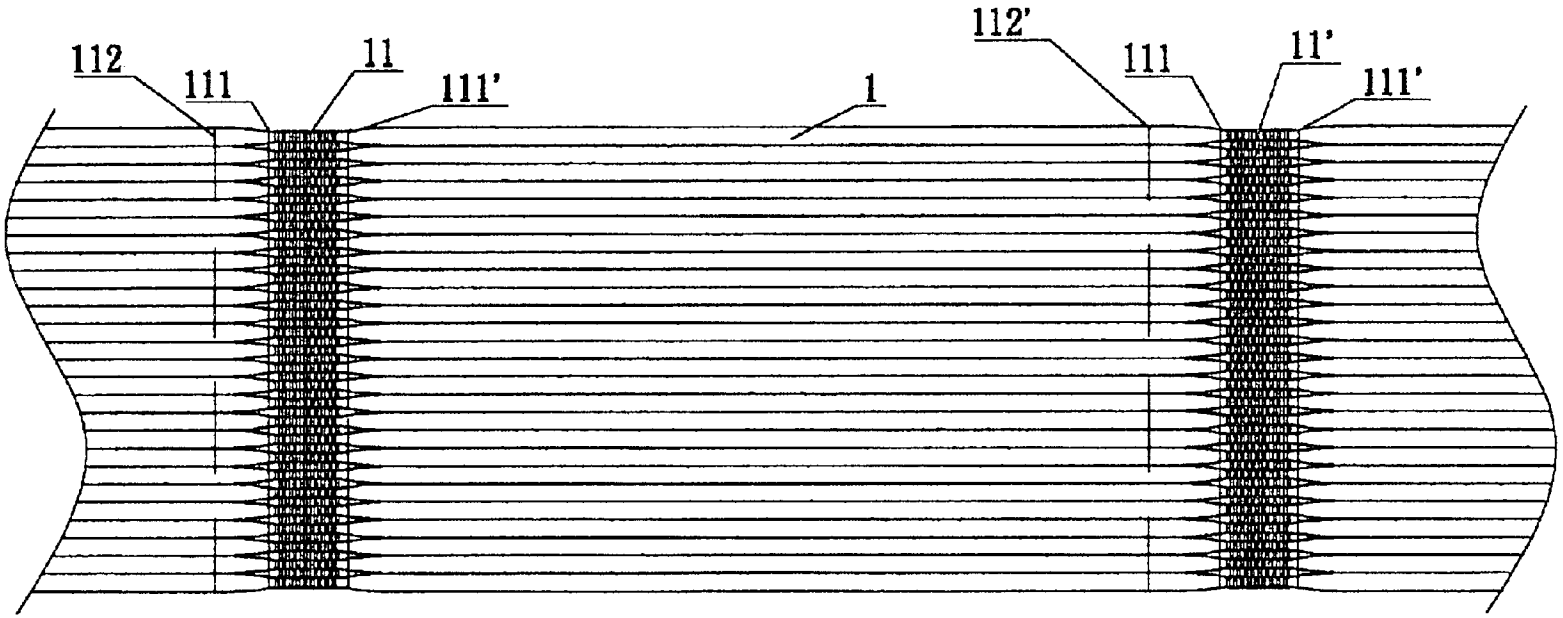
FIG. 1B is a schematic diagram of weaving a piece of plastic cloth with plastic tapes by the square weaving method of the weaving machine.
Figure 1C:
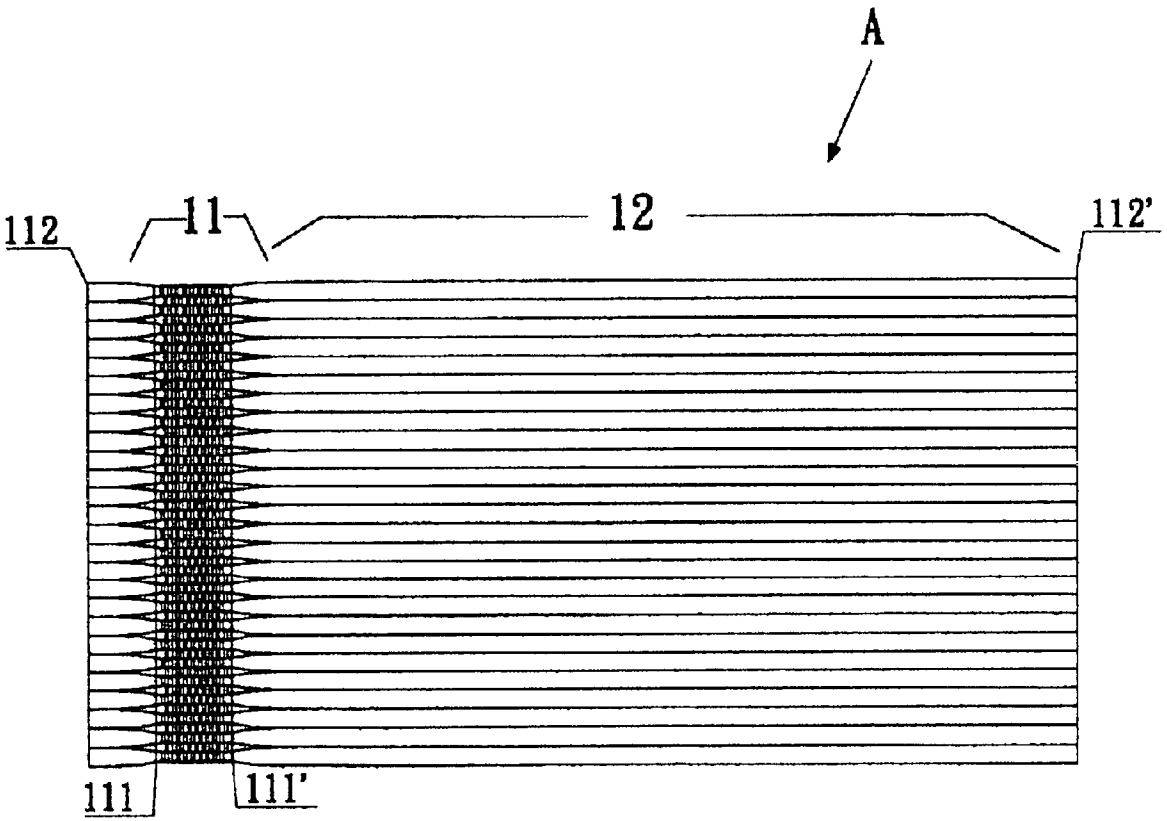
FIG. 1C is schematic diagram of a plastic ribbon unit after weaving.

Please refer to FIG. 1A. The plastic tape 1 could be of different colors according to the requirement for the layout of the warp or weft. Please refer to FIG. 1B. The plastic tape 1 is weaved according to the width limitation of the required weaved section 11 and the setting of the distance between weaved section 11 and weaved section 11' to form a continuous piece of plastic cloth. In the meantime, the simulated cut line on the sides of weaved section 111 or weaved section 111' is cut to produce plastic weaved ribbon units A, and the width of each section has a weaved section 11 and a tassel section 12 (as shown in FIG. 1C) which can be cut as required. Further, both sides of the weaved section 11 (11') of the plastic weaved ribbon unit A is sewed with stitches 111 (111') such that the plastic tape will not be detached.

Figure 2:
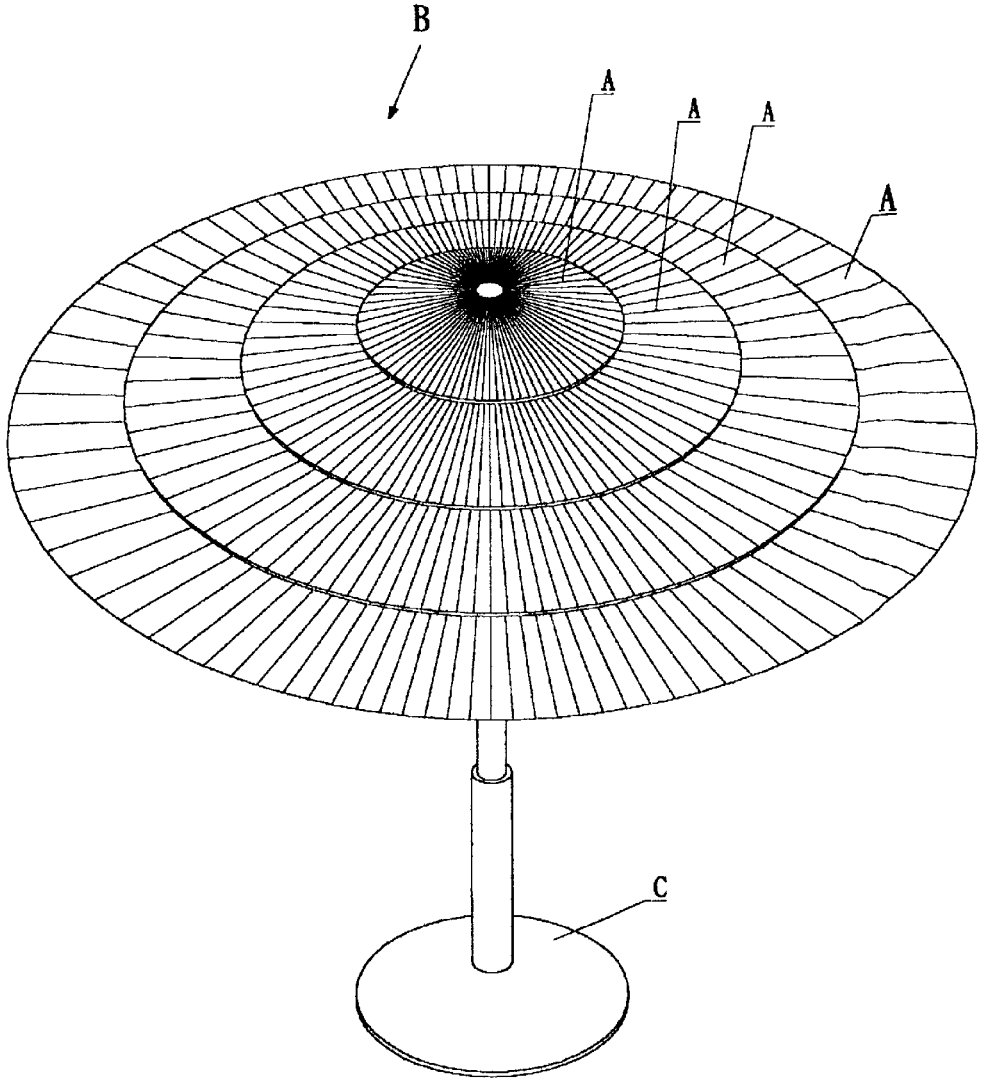
FIG. 2 is a diagram of the opened straw umbrella of an embodiment of the present invention.
Figure 3:
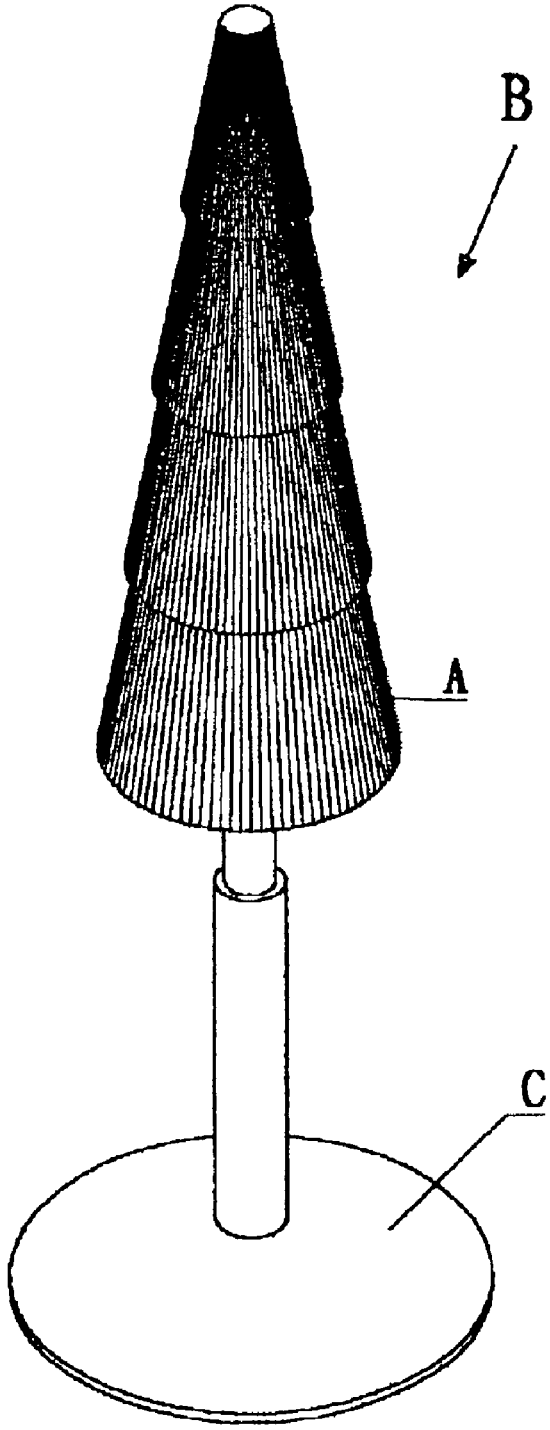
FIG. 3 is a schematic diagram of the closed straw umbrella according to a preferred embodiment of the present invention.
Figure 4:
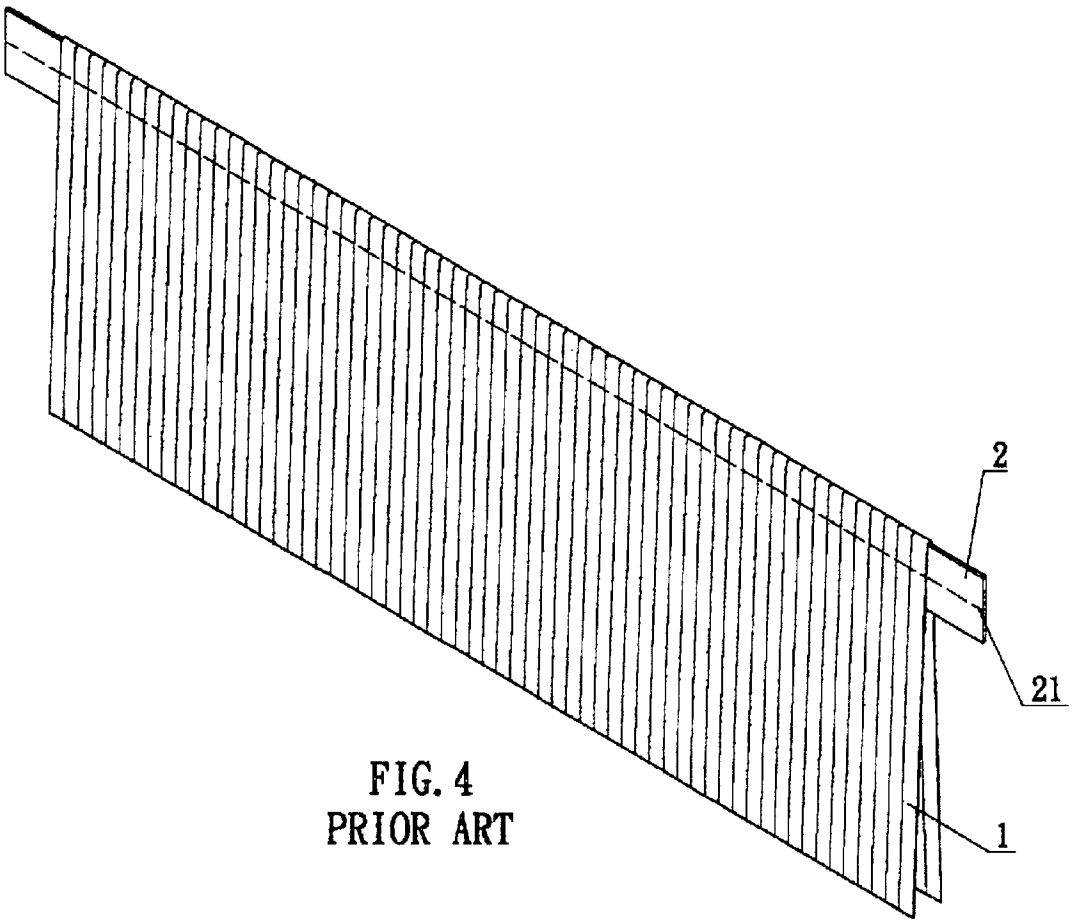
FIG. 4 PRIOR ART
FIG. 4 is a diagram of the assembly of the prior-art straw decorative ribbon.

Please refer to FIG. 2. The plastic waved ribbon units A can be stacked or leaned with each other and laid out on the canopy of an umbrella to produce a straw umbrella (see FIG. 2), which can be closed in the same way as a regular umbrella (as shown in FIG. 3). A supporting stand C is provided at the lower section of the rack of the straw umbrella B, which gives an easy and convenient way for transportation and storage, and also provides a way for mass production and the economic effect of lowering cost.

Further, the weaved section 11 of the plastic ribbon unit A so produced can be attached to all kinds of purse, clothing, or Christmas decorative ribbons for all kinds of applications.

In summation of the above description, the present invention makes use of a simple manufacturing method to provide a way for mass production, and attain the economic effect of lowering cost. The present invention further complies with the patent application requirements and is submitted to the Patent and Trademark Office for review and granting of the commensurate patent rights.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A method of manufacturing straw decorative ribbon from a plastic tape, which comprises the steps of:

a) selecting a plastic tape for weaving by a square weaving method on a weaving machine;

b) controlling a width of a plurality of woven sections and a length of a plurality of tassel sections;

c) forming a continuous plastic cloth having a plurality of decorative ribbon units along a length thereof, each of the plurality of decorative ribbon units having one woven section of the plurality of woven sections and one tassel section of the plurality of tassel sections, each woven section being located between two adjacent tassel sections;

d) cutting each of the plurality of decorative ribbon units at each of two opposing ends thereof, the woven section of each of the plurality of straw decorative ribbons being located adjacent to one of the two opposing ends; and e) stitching two sides of the woven section of each of the plurality of decorative ribbon units.

2. The method according to claim 1, wherein the stitching step e) is followed by the step of forming a straw umbrella canopy by connecting at least one of the plurality of decorative ribbon units to a canopy of an umbrella.

3. The method according to claim 1, wherein the stitching step e) is followed by the step of attaching at least one of the plurality of decorative ribbon units to an item selected from a group of items consisting of a purse, an article of clothing and a decorative ornament.

4. The method according to claim 1, wherein the cutting step d) includes the step of cutting each of the plurality of decorative ribbon units to be a predetermined width.

* * * * *